US007754028B2

(12) United States Patent
Blaauw et al.

(10) Patent No.: US 7,754,028 B2
(45) Date of Patent: Jul. 13, 2010

(54) PLASMA-NITRIDING OF MARAGING STEEL, SHAVER CAP FOR AN ELECTRIC SHAVER, CUTTING DEVICE MADE OUT OF SUCH STEEL AND AN ELECTRIC SHAVER

(75) Inventors: Hubert Sjoerd Blaauw, Drachten (NL); Hans De Beurs, Drchten (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 635 days.

(21) Appl. No.: 10/522,287

(22) PCT Filed: Jul. 22, 2003

(86) PCT No.: PCT/IB03/03190

§ 371 (c)(1),
(2), (4) Date: Jan. 25, 2005

(87) PCT Pub. No.: WO2004/013367

PCT Pub. Date: Feb. 12, 2004

(65) Prior Publication Data

US 2005/0236070 A1 Oct. 27, 2005

(30) Foreign Application Priority Data

Jul. 29, 2002 (EP) ..... 02078110

(51) Int. Cl.
*C23C 8/38* (2006.01)
*C23C 8/26* (2006.01)

(52) U.S. Cl. ..... 148/222; 148/318

(58) Field of Classification Search ..... 148/222, 148/318
See application file for complete search history.

(56) References Cited

U.S. PATENT DOCUMENTS

| | | | | |
|---|---|---|---|---|
| 5,306,531 | A * | 4/1994 | Laurence et al. | 427/569 |
| 5,503,687 | A | 4/1996 | Berns | |
| 5,536,549 | A | 7/1996 | Nelson et al. | |
| 6,007,871 | A | 12/1999 | Horikoshi et al. | |
| 6,033,496 | A | 3/2000 | Hisano et al. | |

FOREIGN PATENT DOCUMENTS

| | | | |
|---|---|---|---|
| EP | 1094127 | A2 | 7/1996 |
| EP | 0743144 | A2 | 11/1996 |
| EP | 0743144 | B1 | 11/1996 |
| EP | 0743144 | A3 | 2/1999 |

OTHER PUBLICATIONS

Perkas, M.D., TsNiiChERMET. Translated from Metallovedenie i Termicheskaya Obrabotka Metallov: "High-Strength Maraging Steels", No. 6, Jun. 1968, pp. 415-425.*

* cited by examiner

*Primary Examiner*—Roy King
*Assistant Examiner*—Jessee R. Roe

(57) ABSTRACT

The invention relates to a method for the plasma-nitriding of precipitation-hardenable stainless steels or stainless maraging steels. The invention also relates to a shaver cap for an electric shaver. The invention also relates to a cutting device. The invention further relates to an electric shaver comprising at least one such cutting device.

18 Claims, No Drawings

PLASMA-NITRIDING OF MARAGING STEEL, SHAVER CAP FOR AN ELECTRIC SHAVER, CUTTING DEVICE MADE OUT OF SUCH STEEL AND AN ELECTRIC SHAVER

BACKGROUND OF THE PRESENT SYSTEM

The invention relates to a method for the plasma-nitriding of precipitation hardenable stainless steels or stainless maraging steels. The invention also relates to a shaver cap and a cutting device. The invention further relates to an electric shaver.

For years, maraging steels have been used in industry for applications where hardened steel was necessary. Old established methods for hardening steel, some dating back thousands of years such as heating and quenching, have been supplemented with more advanced methods, such as plasma nitriding, whereby nitrogen is included in the structure of the metal. This alteration of the structure of the metal yields a thin layer of hardened metal on the outside of the steel item, making it much more wear-resistant.

Given the many useful qualities of stainless steels, these have found wide application in all kinds of fields. Hardness, however, is not a particularly strong point of stainless steel. Hardening of stainless steel is compromised because of unwanted reactions, which do make the steel harder but also reduce its corrosion resistance.

To date maraging steel has mostly been employed in situations where hardness was a prime factor, but the corrosion resistance of maraging steels leaves room for improvement. A recent example of the dilemma between hardness and corrosion resistance proved to be the Coolskin Philishave®. This is an electric shaver that can be used for wet shaving, and was developed to combine the advantages of wet shaving with a razor with the safety features of an electric shaver. The shaver uses a shaver head with an outer blade made of very thin steel. Since the introduction of the Coolskin Philishave® there has been a problem in that the outer blade wears too fast. Because of the required hardness, this blade is made of maraging steel for want of a sufficiently hard stainless steel alternative, but this still proves to be insufficiently hard-wearing. At the same time it has become clear that improved corrosion resistance is also desired, and although above especially mentioned in relation to the Coolskin Philishave type of shaver it will be clear that improvement of the corrosion resistance of a cutting element of another type of shaver is also advantageous.

Further hardening of maraging steel according to the present state of the art has the disadvantage that the hardness can indeed be increased, but then the toughness decreases accordingly. In other words, hardened steel becomes brittle, making it unsuitable for certain purposes. It can be imagined that this problem is less acute in, say, ball bearings where the hardened surfaces are inflexible than in a shaver blade which is very thin (order of magnitude of 70 μm) and flexible. Increased hardening impairs the corrosion resistance of the maraging steel.

Steel exists in various crystalline states, that is to say the atoms can be arranged in different configurations. Also the addition of other elements can alter the atomic configuration of steel, and thereby its characteristics. Stainless steel, for example, is an alloy of steel with up to 18% chromium and around 11% nickel, giving this steel its stainless corrosion-resistant properties. Steel itself is harder than pure iron because it contains carbon. The main states of the steel of interest for the present invention are martensite and austenite. Of these, austenite is the softer, more deformable state. In general it can be said that items are shaped with the metal in the austenitic state and subsequently hardened by heating to transform the metal at least partly into the martensitic state. Traditionally the steel is quenched, i.e. rapidly cooled off, in order to maintain the martensitic state at a lower temperature. Another widely used method is precipitation hardening.

Several solutions have been proposed in the art to the problem of improving the hardness of certain stainless steels and non-stainless maraging steels. EP 1 008 659 discloses a method for the production of steel plates from a specific type of martensite hardening steel. The method disclosed teaches that the age hardening temperatures have to stay below the martensite/austenite transition temperature and that also the surface hardening is realized at temperatures below the martensite/austenite transition temperature. A drawback of the method known in the art is that this method can only be applied to iron-nickel-cobalt maraging steel, which is not corrosion-resistant.

BRIEF SUMMARY OF THE PRESENT SYSTEM

The object of the invention is to provide a type of steel that is both very hard and very well corrosion-resistant, while maintaining sufficient tensile strength.

To achieve this object, the invention provides a method for the plasma-nitriding of precipitation hardenable steels or maraging steels, characterized in that the maraging steel is a stainless maraging steel and the plasma-nitriding is carried out at a temperature below 500° C. The resulting hardness that can be achieved with the method according the invention is in excess of 1400 HV. Also the Young modulus in the compound layer increases by 20% to 25% compared to the base material. The method according to the invention can be applied to already hardened, maraging stainless steel and precipitation-hardenable stainless steel, or to simultaneously precipitation-harden and plasma-nitride the steels. Whereas the prior art discloses a method for the production of steel plates, the present invention can be used for the production of all kinds of products, especially products precisely dimensioned. These products can be produced in the required dimensions before the method according the invention is applied, providing the advantage that also smaller machine parts, like parts of shaver heads or cutting tools, can be produced as very hard and very well corrosion-resistant elements that also have a sufficient toughness.

EP 1 094 127 proposes plasma-nitriding of maraging steel at a temperature between 450 and 530° C. This temperature range corresponds to the transition temperature between martensite and austenite, depending on the composition of the steel. At this temperature steel can be hardened by precipitation-hardening. However, there is no suggestion in this document that the technique could also be usefully applied to stainless steel. U.S. Pat. No. 6,033,496 describes the combined precipitation-hardening and nitriding of maraging steel, which indicates that both processes are carried out simultaneously. U.S. Pat. No. 5,953,966 teaches plasma-nitriding at a temperature below the austenite/martensite transition temperature. This document relates to screwdriver bits, for which a hardness of up to 3,000 HV is obtained. It does not teach the use of this process for stainless steels. U.S. Pat. No. 5,503,687 teaches the use of solution-nitriding of stainless steel at temperatures of between 1000 and 1200° C. Finally, U.S. Pat. No. 6,007,871 teaches the use of plasma-nitriding of chrome-containing steel at 500° C., but combines the technique with the addition of a layer of titanium nitride for further hardness.

The methods according to the prior art present several problems for the production of delicate items, like, for example, the above mentioned shaver blade. Treatment at high temperatures can lead to spatial distortions of the product. Also the formation of chromium compounds, notably chromium nitride, adversely affect the corrosion resistance. But, most important, none of the methods proposed for stainless steels yield sufficient hardness.

DETAILED DESCRIPTION OF THE PRESENT SYSTEM

Preferably, the plasma-nitriding is carried out simultaneously with or consecutively to precipitation-hardening. The combination of nitriding and precipitation-hardening evidently leads to a less complex processing route.

The temperature at which the plasma-nitriding and precipitation-hardening are carried out ranges from 300° C. to 500° C., preferably from 370 to 380° C., more preferably 375° C., depending on the composition of the material involved, but never exceeds 500° C. The duration of the plasma-nitriding method according to the invention depends on the desired thickness of the hardened layer and the temperature used. For example, plasma-nitriding at 500° C. for 2 hours gives a 22 μm layer thickness, at 450° C. for 5 hours gives a 17 μm layer thickness, and at 375° C. for 20 hours gives an 8 μm layer thickness. The plasma-nitriding according to the invention is otherwise carried out in accordance with the state of the art and uses a pulsed plasma mode and nitrogen as a nitrogen source. The resulting hardness may be as high as 1500 HV, a remarkable value in view of the prior art, notably U.S. Pat. No. 6,007,871.

The method according to the present invention can be applied to produce any steel item that is required to be both very well corrosion-resistant and hard-wearing. The method according to the present invention is particularly suitable for items that are thin and/or of intricate shape and that demand high tensile strength. Examples of such items are shaver blades, razors, cutting tools, rotating knives, for example in kitchen equipment, automotive parts, and many other items.

The invention also relates to a shaver cap for an electric shaver made of maraging or precipitation-hardenable stainless steel, characterized in that the maraging steel or stainless steel shaver cap is plasma-nitrided at a temperature below 500° C. Advantages of said stainless steel have been described above. The shaver cap according the present invention is not restricted to a cap for a specific type of electric shaver; all types of electric shavers can be provided with the cap according the invention.

The invention also relates to a cutting device made of maraging or precipitation-hardenable stainless steel, characterized in that the maraging steel or stainless steel is plasma-nitrided at a temperature below 500° C. With a cutting device or cutting element is meant an individually operating shaver blade or a shaver blade that works in cooperation with another shaver blade. Such a construction of cooperating shaver blades can be found, for example, in a shaver with an internal moving (e.g. rotating or linear reciprocating) cutting element that is surrounded by an external counter cutting element (cap) that has a stationary position. Both the internal rotating cutting element and the external stationary counter cutting element are referred to in this document as cutting elements.

The invention further relates to an electric shaver comprising at least one such cutting element.

The present invention will be further illustrated by means of several non-limitative examples given below.

EXAMPLE 1

Manufacture of a shaving cap according to the invention out of Sandvik 1RK91 stainless maraging steel with plasma-nitriding and ageing combined in one process step.

A shaving head is stamped out of strip material, and the microstructure is transformed for 70% into martensite with a resulting hardness of 300 HV by heat treatment. The shaving head is machined into its final shape with slots and holes. After this the shaving head is treated in a pulsed plasma-nitriding furnace at 375° C. for 20 hours at a nitrogen pressure of between 300 and 475 Pa. While the shaving head is being nitrided, the precipitation hardening (ageing) takes place at the same time. With an average thickness of the lamellae of around 70 μm this results in a compound layer of 10 to 20 μm. This is illustrated in the cross-section of a hardened lamellae in FIG. 1. In the remaining base material enveloped by the compound layer, the hardness is increased to 500 HV by precipitation-hardening (ageing). The hardness reaches 1500 HV in the compound layer owing to the combination of precipitation hardening (ageing) and nitriding.

EXAMPLE 2

Manufacture of a cutting device according to the invention out of Sandvik 1RK91 stainless maraging steel or Carpenter Custom 465 stainless maraging steel with plasma-nitriding and ageing combined in one process step.

A rotary shaver cutter is stamped and formed out of 0.30 mm thick cold-rolled strip material with an as received microstructure comprising about 80% martensite and having a hardness of more than 325 HV. The cutter legs are made flat and sharpened by spark erosion. After this the shaving head is treated in a pulsed plasma nitriding furnace at 375° C. for 20 hours at a nitrogen pressure of between 300 and 475 Pa While the rotary cutter shaving head is being nitrided, the precipitation hardening (ageing) takes place at the same time. A compound layer of 10 to 20 μm is formed into all surfaces of the cutter. In the remaining base material enveloped by the compound layer, the hardness is increased by precipitation hardening (ageing) to 500 HV or higher. The hardness reaches 1500 HV in the compound layer via the combination of precipitation hardening (ageing) and nitriding.

The invention claimed is:

1. A method of forming a shaver blade, the method comprising acts of:

forming stainless maraging steel into the shaver blade; and plasma-nitriding of the shaver blade at a temperature below 500° C.

2. The method of claim 1, wherein the plasma-nitriding is carried out consecutively to precipitation-hardening.

3. The method of claim 2, wherein at least one of the plasma-nitriding and the precipitation-hardening is carried out at a temperature between 300° C. and 380° C.

4. The method of claim 1, wherein the plasma-nitriding is carried out simultaneously with precipitation-hardening.

5. The method of claim 4, wherein at least one of the plasma-nitriding and the precipitation-hardening is carried out at a temperature between 300° C. and 380° C.

6. A method of forming a shaver blade, the method comprising acts of:

forming stainless maraging steel into the shaver blade; and plasma-nitriding of the shaver blade at a temperature between 300° C. and 380° C.

7. The method of claim 6, wherein the plasma-nitriding is carried out simultaneously with or consecutively to precipitation-hardening.

8. The method of claim 7, wherein at least one of the plasma-nitriding and the precipitation-hardening is carried out at a temperature between 300° C. and 375° C.

9. The method of claim 7, wherein the at least one of the plasma-nitriding and the precipitation-hardening is carried out at a temperature between 370° C. and 380° C.

10. The method of claim 7, wherein the at least one of the plasma-nitriding and the precipitation-hardening is carried out at a temperature of 375° C.

11. The method of claim 7, wherein the precipitation-hardening is carried out at a temperature between 300° C. and 380° C.

12. The method of claim 7, wherein the plasma-nitriding is carried out at a temperature between 370° C. and 380° C.

13. The method of claim 7, wherein the plasma-nitriding is carried out at a temperature of 375° C.

14. A method of forming a shaver cap, the method comprising acts of:

forming stainless maraging steel into the shaver cap; and plasma-nitriding of the shaver cap at a temperature below 500° C.

15. The method of claim 14, wherein the plasma-nitriding is carried out at a temperature between 300° C. and 380° C.

16. The method of claim 14, wherein the plasma-nitriding is carried out at a temperature between 370° C. and 380° C.

17. The method of claim 14, wherein the plasma-nitriding is carried out simultaneously with or consecutively to precipitation-hardening.

18. The method of claim 17, wherein at least one of the plasma-nitriding and the precipitation-hardening is carried out at a temperature between 300° C. and 380° C.

* * * * *